US009132846B2

(12) United States Patent
Przybylski

(10) Patent No.: US 9,132,846 B2
(45) Date of Patent: Sep. 15, 2015

(54) AUTOMATIC WIRELESS NETWORK SYNCHRONIZATION OF A PHYSICALLY CONNECTED LOCOMOTIVE CONSIST

(71) Applicant: Electro-Motive Diesel, Inc., LaGrange, IL (US)

(72) Inventor: Lawrence Stanley Przybylski, Lemont, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 161 days.

(21) Appl. No.: 13/654,935

(22) Filed: Oct. 18, 2012

(65) Prior Publication Data

US 2014/0114508 A1 Apr. 24, 2014

(51) Int. Cl.
*B61L 15/00* (2006.01)

(52) U.S. Cl.
CPC ..... *B61L 15/0072* (2013.01); *B61L 15/0027* (2013.01)

(58) Field of Classification Search
CPC ..... B61L 3/008; B61L 3/006; B61L 2200/26; B60T 13/665; Y02T 10/7258
USPC ..... 701/19, 20, 70; 455/405, 502, 509; 375/138, 219, 354; 370/328, 469; 340/425.5, 438, 5.52
See application file for complete search history.

(56) References Cited

U.S. PATENT DOCUMENTS

| | | | | |
|---|---|---|---|---|
| 5,777,547 | A | 7/1998 | Waldrop | |
| 7,021,589 | B2 | 4/2006 | Hess, Jr. et al. | |
| 7,618,011 | B2 | 11/2009 | Oleski et al. | |
| 8,073,582 | B2 | 12/2011 | Kellner et al. | |
| 2007/0266236 | A1 * | 11/2007 | Colditz | 713/153 |
| 2011/0284700 | A1 * | 11/2011 | Brand et al. | 246/28 R |
| 2012/0123617 | A1 * | 5/2012 | Noffsinger et al. | 701/19 |
| 2012/0287972 | A1 * | 11/2012 | Noffsinger et al. | 375/219 |
| 2013/0022054 | A1 * | 1/2013 | Goodermuth et al. | 370/431 |
| 2014/0129061 | A1 * | 5/2014 | Cooper et al. | 701/19 |

FOREIGN PATENT DOCUMENTS

WO 2012037208 A1 3/2012

* cited by examiner

*Primary Examiner* — Tuan C. To
*Assistant Examiner* — Jelani Smith
(74) *Attorney, Agent, or Firm* — BakerHostetler

(57) ABSTRACT

A system and method for automatically establishing a wireless network between multiple units in a locomotive consist. A leading locomotive may transmit through the MU cable a ping signal to a remote unit that is directly or indirectly connected to the leading locomotive. When the remote unit replies to the ping, the leading locomotive may transmit through the MU cable network setup information to the remote unit. The remote unit may automatically setup its network controls using the data provided by the leading locomotive to communicate with the leading locomotive through a wireless network.

20 Claims, 5 Drawing Sheets

AUTOMATIC WIRELESS NETWORK SYNCHRONIZATION OF A PHYSICALLY CONNECTED LOCOMOTIVE CONSIST

TECHNICAL FIELD

The present disclosure relates to locomotive consist communication and networking. More particularly, the present disclosure relates to systems and methods for automatically synchronizing a network of multiple locomotives or units in a locomotive consist using an Internet Protocol (IP) address associated with each MU.

BACKGROUND

A locomotive is a railway vehicle that provides the motive power for a train. Generally, a locomotive carries no payload of its own, and its sole purpose is to move the train along the tracks. In contrast, self-propelled payload-carrying vehicles may be referred to as motor coaches or railcars.

Locomotives can be operated as single traction engines to pull or push strings of non-powered cars that together form a train. The locomotive power required to get a train from one point to another depends on various sources of resistance that need to be overcome. These resistances include the length of the train, drag from bearing friction, rail/wheel deflection, head wind, terrain, etc.

Continuous sources of drag can prevent the operation of a train at a desired speed. Additionally, propelling a train up steep grades or on slippery rail can exceed a single locomotive's power or the amount of tractive effort it can supply. A trailing locomotives may be connected to what could be considered the "lead" locomotive to provide the additional horse power or torque to push or pull a train.

A "locomotive consist" is a group of two or more locomotives. The locomotive consist as indicated earlier includes a lead locomotive and one or more trailing locomotives that are mechanically coupled and could be electrically coupled.

The mechanical coupling could be accomplished with a "coupler" and the electrical connection could be accomplished using the 27-pin control plug, cable and receptacle. The power and braking systems could use this control plug, cable and receptacle for communication so that the group of locomotives function together as a single unit. This 27-pin conductor cable is often referred to in the industry as the MU cable in that it physically connects multiple locomotives/units together. This connection could allow the lead locomotives to communicate to trailing units. The Association of American Railroads (AAR) specifies which functions are assigned to which pins. MU cables have been used since the 1930s to link the control systems which originally primarily consisted of relays and analog circuitry, typically communicating a simple ON/OFF state.

With advances in technology and computing devices, this basic link is no longer adequate. The ability to communicate more information, bi-directionally, and at a faster rate allows for the implementation of new processes and applications such as fuel management, advanced diagnostics, redundancy of components at a consist level, etc.

There are a number of ways to create an intra-consist network. Communication may be accomplished by adding high-speed network cables to the locomotives, or wirelessly. A wireless connection has various advantages, including retrofitting relatively easily existing locomotives, and providing a communication means between locomotives that are part of the consist but that are not electrically connected using the MU cable.

As of yet, establishing a communication network between units of a locomotive consist required the intervention of an operator. The operator would manually configure computers in each of the units by supplying each computer with the data required to connect to the network, including a password, a key code, and/or various parameters required for network communication. This process is time consuming, inefficient and prone to human errors.

The networked inter-locomotive communication systems in the prior art require considerable user intervention for setting up a network, and they are unable to automatically restore themselves in the event of an interruption.

There is a need for an intra-consist networked communication systems and methods that overcomes the above-mentioned shortcomings.

SUMMARY

One aspect of the present disclosure provides a method of automatically setting up a wireless communication network in a locomotive consist. The method includes transmitting from a leading locomotive a ping to a first trailing locomotive through a first MU cable, receiving from the first trailing locomotive a reply ping through the first MU cable, and transmitting wireless network setup information through the first MU cable from the leading locomotive to the first trailing locomotive.

Another aspect of the present disclosure provides a communication control system for automatically setting up a wireless communication network in a locomotive consist. The system includes a first controller in a leading unit, a second controller in a trailing unit, and an MU cable connecting the leading unit with the trailing unit, wherein the first controller is adapted to communicate to the second controller a ping through the MU cable.

DETAILED DESCRIPTION

Figure 1:
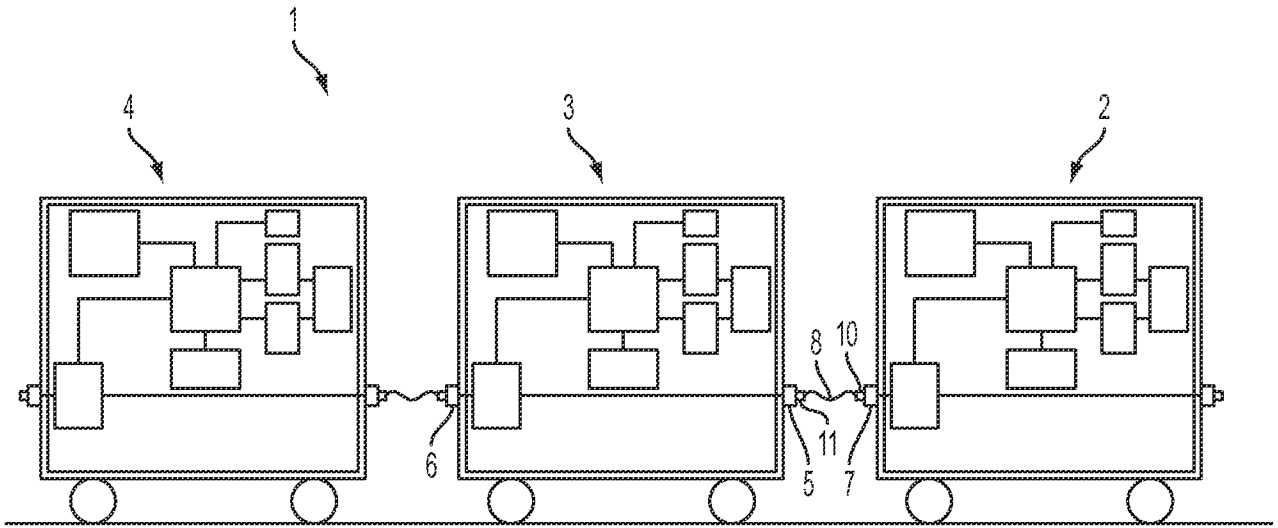
FIG. 1 is a diagram of locomotive consist equipped with an automatically synchronizing wireless communication system, according to an embodiment of the present invention.

FIG. 1 is a diagram of locomotive consist equipped with an automatically synchronizing wireless communication system, according to an embodiment of the present invention. Locomotive consist 1 includes a group of two or more locomotives 2, 3 and 4 linked together to travel along a rail. Locomotive 2 may be considered the lead unit (because this unit has the lead/trail switch set to LEAD), and locomotive 4 would then be considered a trailing unit (because this unit has the lead/trail switch set to TRAIL). The locomotives are equipped with various control system components further described below to control communication and propulsion. The multiple units are connected to each other with MU cable 8 connecting the MU receptacle 7 and MU plug 10 of locomotive 2 to the MU receptacle 5 and MU plug 11 of locomotive 3.

Locomotives may need to communicate an increasing amount of data at a fast rate in order to share the data and communicate control commands throughout the consist. The data could include environmental sensory data, fuel gauge data, diagnostic data, etc. The control commands could include acceleration or deceleration commands.

As described in detail below, the MU cables provide a connection which allows the leading locomotive to communicate with the rest of the units in the consist. This communication could be used to setup a high-speed wireless network of communication to share data throughout the consist and issue commands from the leading locomotive to any of the locomotives connected to the network.

For example, a leading locomotive may communicate with the last trailing locomotive to coordinate acceleration and deceleration. In the event that a sensor malfunctions in locomotive 2, the identical sensor in locomotive 3 or locomotive 4 may communicate the sensor information through the data network to locomotive 2. This redundancy ensures the continued operation of the consist regardless of the occasional failure of certain sensors. The data network between locomotives may use packet switching for transmitting the data throughout the network. Locomotives may be identified using an Internet Protocol (IP) address.

The data exchanged between locomotives may be encrypted for security purposes. For example, event recorder data may be encrypted and exchanged between locomotives and saved on multiple locomotives. An encryption module may be integrated within a control unit, or may be separate from the control unit.

In an embodiment of the present disclosure, a wireless network is formed to share data throughout the consist. The leading locomotive 2 can transmit data through the MU cables throughout the consist to provide each locomotive with the necessary information to automatically connect to a wireless network established by the lead unit without the intervention of an operator. As described in detail below with respect to FIGS. 3 and 4, this process takes place automatically as soon as an MU cable is connected between the leading locomotive and any number of trailing units in the consist.

Figure 2:
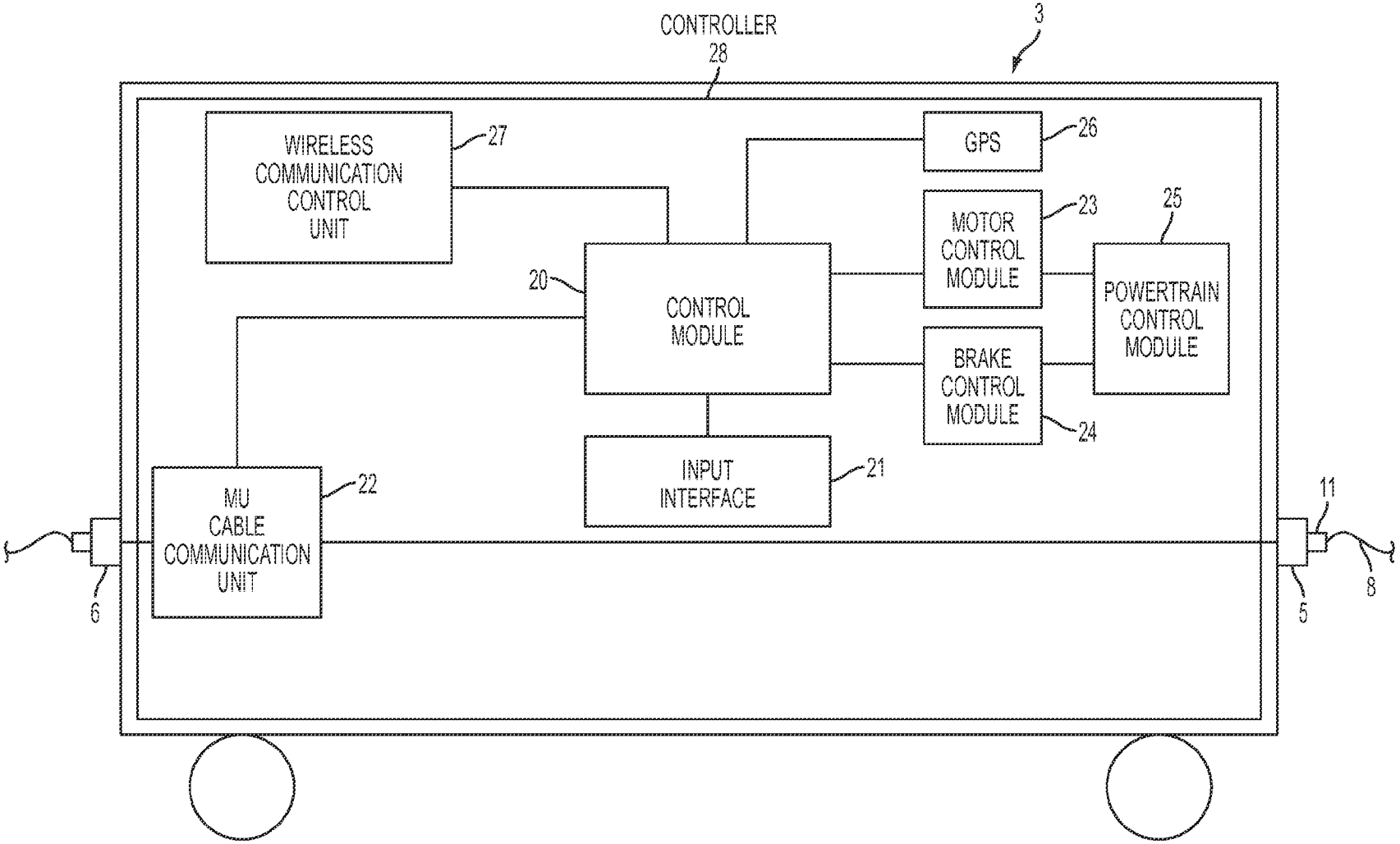
FIG. 2 is a block diagram of locomotive controller, according to an embodiment of the present invention.

FIG. 2 is an exemplary block diagram of a locomotive controller, according to an embodiment of the present invention. Controller 28 contains various modules to control acceleration and deceleration, manage sensory data and wireless communication, among other tasks.

The control module 20 receives data and/or instructions through the MU cable communication unit 22. The control module 20 may also receive an input from input interface 21, which may include a keyboard, a touch screen, a computer, a pad, a mobile device, a panel of relays and/or switches, etc. Control module 20 may include a processor, a hard disk, a static or dynamic memory, a parallel to serial data stream converter, and software and/or firmware code.

Control module 20 communicates acceleration/deceleration commands to the powertrain control unit 25 through the motor control unit 23 and the brake control unit 24. Control module 20 also communicates with GPS module 26 in order to obtain global positioning data relating to the location of the MU. Wireless communication control unit 27 manages the wireless transmission of data. Wireless communication control unit 27 may use any type of wireless communication, including WIFI (IEEE 802.11), UWB (IEEE 802.15.3a), 3G, 4G LTE, etc. along with any of the various security protocols such as WPA, WPA2, WPS, etc. For example, the global positioning (GPS) data may be communicated to the leading unit or to the home office via a cellular transmitter integrated in the wireless communication control unit 27. Another example, the data relating to sensory information may be communicated between locomotives using a commercial long-range WIFI transmitter.

INDUSTRIAL APPLICABILITY

Figure 3:
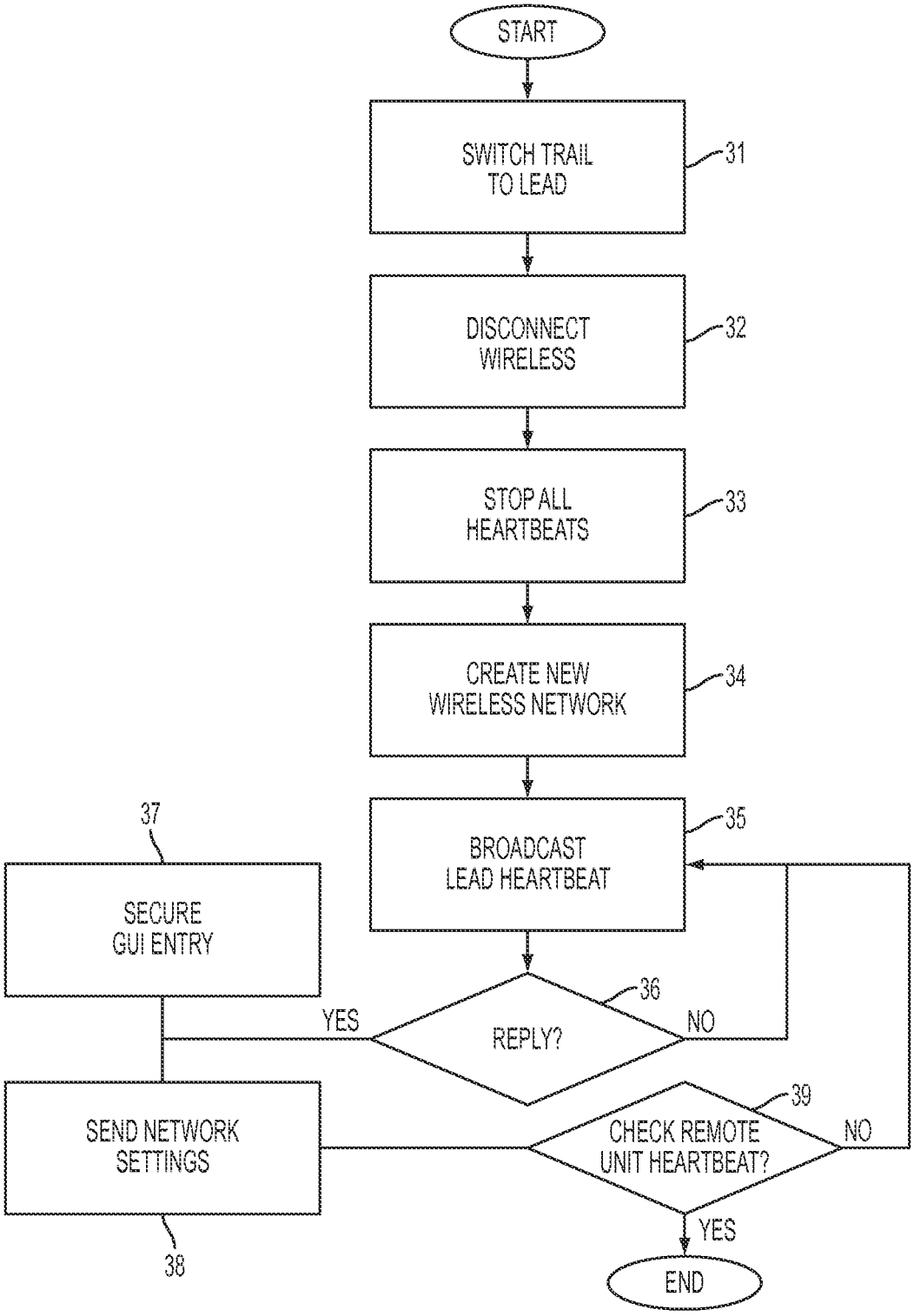
FIG. 3 is a flow chart of a procedure for automatically synchronizing the wireless communication of a leading locomotive, according to an embodiment of the present invention.

FIG. 3 is a flow chart of a procedure for automatically synchronizing the wireless communication of a leading locomotive, according to an embodiment of the present invention. When the status of a locomotive is switched from "TRAIL" to "LEAD" or the locomotive control system powers up with a "LEAD" setting (step 31) the locomotive may disconnect itself from any network it is connect to (step 32) and stop the transmission of any heartbeats (step 33). A heartbeat may be a form of a ping, as commonly known in the computer networking industry.

A ping may operate by sending Internet Control Message Protocol (ICMP) echo request packets to a target host (including any locomotive in the consist) and waiting for an ICMP response. In the process it may measure the time from transmission to reception (round-trip time) and may record any packet loss. The results of the test may be used as statistical summary of the response packets received, including the minimum, maximum, and the mean round-trip times, and sometimes the standard deviation of the mean.

Depending on the implementation, the ping command can be run with various command line switches to enable special operational modes. Example options include: specifying the packet size used as the probe, automatic repeated operation for sending a specified count of probes, and time stamping.

In step 34 of FIG. 3, the leading locomotive may create a new wireless network and broadcast the lead heartbeat/ping/message (step 35). In step 36, the leading locomotive may continuously listen for a reply heartbeat/ping/reply. When the leading locomotive receives a reply it may send network setup information to the remote unit that replied (step 38). Once the remote unit is connected to the wireless network, it may continuously transmit a heartbeat/ping to the leading locomotive. The remote unit may remain connected to the wireless network as long as its heartbeat is received by the leading locomotive. If the leading locomotive no longer receives the heartbeat of the remote unit, then the remote unit is disconnected from the network and the process may restart from step 35.

Figure 4:
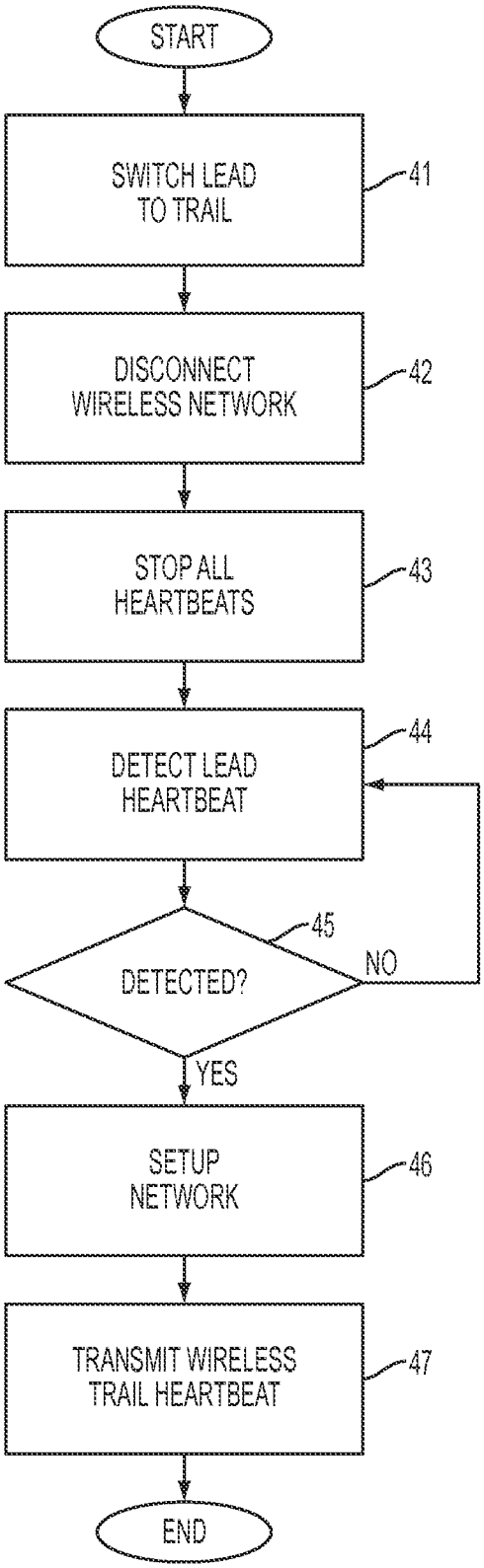
FIG. 4 is a flow chart of a procedure for automatically synchronizing the wireless communication of a trailing locomotive, according to an embodiment of the present invention.

FIG. 4 is a flow chart of a procedure for automatically synchronizing the wireless communication of a trailing locomotive, according to an embodiment of the present invention. When the status of a locomotive is switched from "LEAD" to "TRAIL" or the locomotive control system powers up with a "TRAIL" setting (step 41) the locomotive may disconnect itself from any network it is connect to (step 42) and stop the transmission of any heartbeats/pings (step 43). As discussed above, a heartbeat may be a form of a ping, as commonly known in the computer networking industry. The trailing locomotive may continuously attempt to detect the heartbeat/ping of the leading locomotive. When the leading heartbeat/ping is detected then the trailing locomotive may reply to the lead unit and connect to the wireless network using the wireless network setup data transmitted to it by the leading locomotive via the MU cable. Once connected to the network, the trailing locomotive may continuously transmit wirelessly its heartbeat to the leading locomotive. If the leading locomotive does not detect the heartbeat/ping of the trailing locomotive, then the trailing locomotive may be disconnected from the network and the process may restart at step 44.

Figure 5:
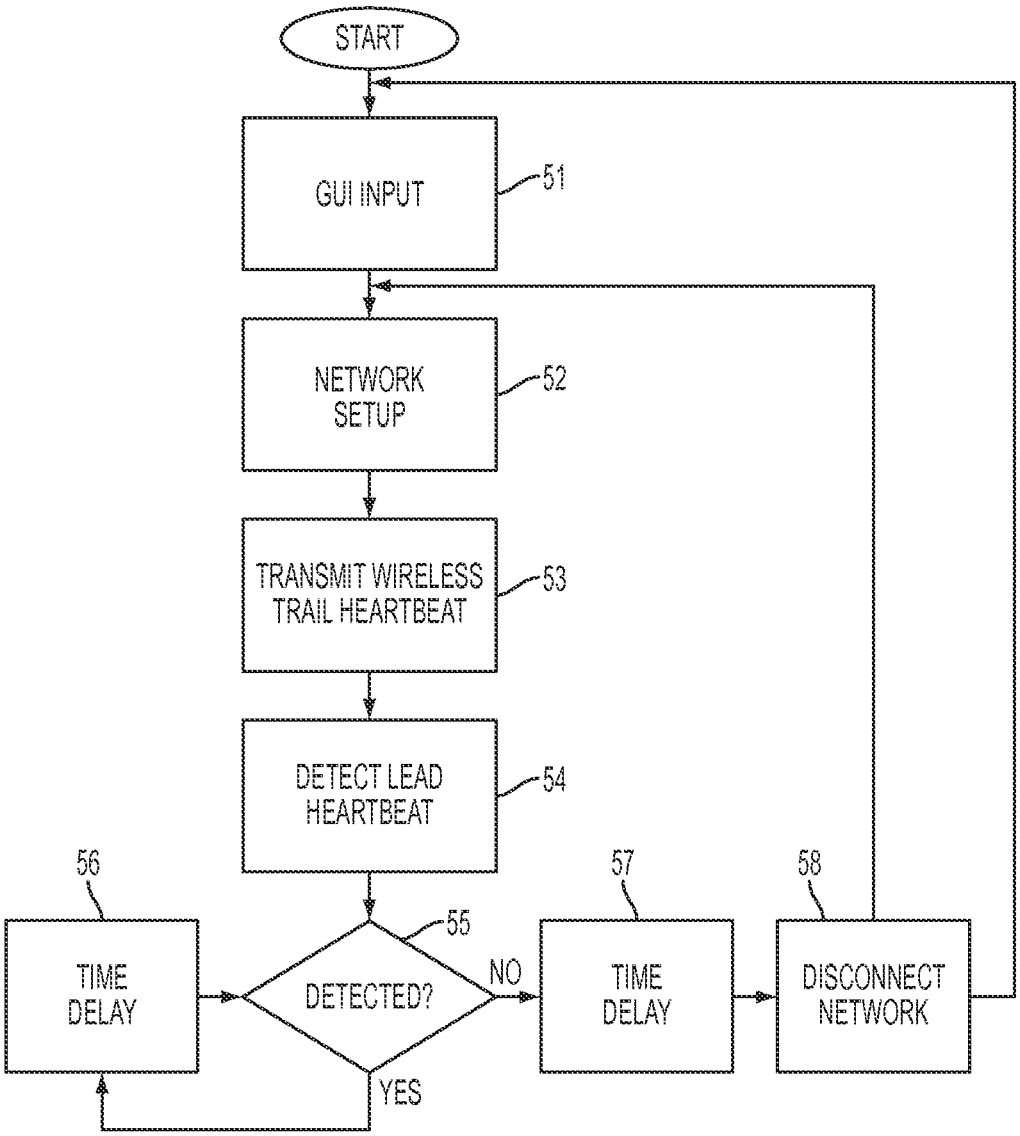
FIG. 5 is a flow chart of a procedure for manually synchronizing wireless communication of a trailing unit, according to an embodiment of the present invention.

FIG. 5 is a flow chart of a procedure for manually synchronizing wireless communication of a trailing unit, according to an embodiment of the present invention. When a trailing unit is unable to receive the leading ping through the MU cable, the wireless network may be setup manually using Input Interface 21) shown in FIG. 2. The trailing unit may accept input from a Graphical User Interface (GUI) (step 51) in order to setup the network for communication (step 52) or to disconnect the trailing unit from the wireless network (step 58). Then, the trailing unit may continuously transmit wirelessly a ping to the lead (step 53) and continuously detect the wireless ping of the leading locomotive (step 54). If either (i) the wireless ping of the leading locomotive is not detected by the trailing locomotive, or (ii) the wireless ping of the trailing locomotive is not detected by the leading locomotive, then after a delay (step 57) the trailing locomotive will be disconnected from the network (step 58)and the process may be restarted at step 51. If, after periodic checks (step 56), (i) the wireless ping of the leading locomotive is detected by the trailing locomotive, and (ii) the wireless ping of the trailing locomotive is detected by the leading locomotive, then the trailing unit may stay connected to the wireless network.

What is claimed is:

1. A method of automatically setting up a new wireless communication network in a locomotive consist, comprising:

transmitting, from a leading locomotive to a first trailing locomotive, a first ping through a first multi-unit (MU) cable, when the leading locomotive disconnects from an established wireless communication network due to the leading locomotive attaining a leading locomotive status;

receiving, from the first trailing locomotive, a first reply ping through the first MU cable;

transmitting, from the leading locomotive to the first trailing locomotive, wireless network setup information through the first MU cable prior to setting up the new wireless communication network, the wireless network setup information including information for setting up the new wireless communication network; and automatically setting up, using the first MU cable, the new wireless communication network based upon the wireless network setup information communicated via the first MU cable to the first trailing locomotive.

2. The method according to claim 1, further comprising:

wirelessly transmitting, from the first trailing locomotive to the leading locomotive, a first trailing wireless ping.

3. The method according to claim 2, further comprising:

receiving, at the leading locomotive, the first trailing wireless ping; and wherein the automatically setting up the new wireless communication network includes forming a wireless link between the leading locomotive and the first trailing locomotive.

4. The method according to claim 1, further comprising:

transmitting a second ping, from the leading locomotive to a second trailing locomotive, through the first MU cable connecting the leading locomotive to the first trailing locomotive and a second MU cable connecting the first trailing locomotive to the second trailing locomotive; and receiving, from the second trailing locomotive, a second reply ping.

5. The method according to claim 4, further comprising:

wirelessly transmitting, from the second trailing locomotive to the leading locomotive, a second trailing wireless ping.

6. The method according to claim 5, further comprising:

receiving, at the leading locomotive, the second trailing wireless ping, wherein the automatically setting up the new wireless communication network includes forming a wireless link between the leading locomotive, the first trailing locomotive and the second trailing locomotive.

7. The method according to claim 6, further comprising:

configuring a third locomotive, not physically connected by an MU cable between a fourth locomotive and the second trailing locomotive, to connect and share data on the wireless communication network between the leading locomotive, the first trailing locomotive and the second trailing locomotive.

8. The method according to claim 7, further comprising:

transmitting commands from the leading locomotive to at least one of the first trailing locomotive, the second trailing locomotive, and the fourth locomotive on the new wireless communication network.

9. The method according to claim 8, wherein the commands control an acceleration of a locomotive on the new wireless communication network.

10. The method according to claim 8, wherein the shared data on the new wireless communication network is encrypted.

11. A communication control system for automatically setting up a new wireless communication network in a locomotive consist, comprising:

a leading unit including a first controller;

a first trailing unit including a second controller; and a first multi-unit (MU) cable connecting the leading unit with the first trailing unit, wherein the first controller is adapted to:

transmit, to the second controller, a first ping through the first MU cable, when the leading unit disconnects from an established wireless communication network due to the leading unit attaining a leading unit status, receive, from the second controller, a first reply ping through the first MU cable, transmit, to the second controller, wireless network setup information through the first MU cable prior to setting up the new wireless communication network, the wireless network setup information including information for setting up the new wireless communication network, and automatically set up the new wireless communication network, using the first MU cable, based upon the wireless network setup information communicated via the first MU cable to the first trailing unit.

12. The system according to claim 11, wherein the first controller includes a first wireless communication control unit, and the second controller includes a second wireless communication control unit.

13. The system according to claim 12, wherein the second controller is adapted to wirelessly transmit, using the second wireless communication control unit, a first wireless ping.

14. The system according to claim 13, wherein the first controller is adapted to configure a wireless link between the leading unit and the first trailing unit.

15. The communication control system according to claim 12, further comprising:

a second trailing unit, including a third controller connected to the first trailing unit through a second MU cable, the third controller including a third wireless communication control unit.

16. The system according to claim 15, wherein the third controller is adapted to receive a second ping from the leading locomotive through the first MU cable and the second MU cable, and transmit a second reply ping.

17. The system according to claim 16, wherein the first controller is adapted to configure a wireless link between the leading unit, the first trailing unit and the second trailing unit.

18. The system according to claim 17, further comprising:

an additional unit, not connected by an MU cable between a fourth locomotive and the second trailing locomotive, including a fourth controller having a fourth wireless communication control unit, the fourth controller adapted to wirelessly connect to the new wireless communication network.

19. The system according to claim 18, wherein the first controller is adapted to encrypt data shared on the new wireless communication network.

20. The system according to claim 19, wherein the encrypted data comprises commands to a plurality of units of the locomotive consist sharing the new wireless communication network.

* * * * *